US007137601B2

(12) United States Patent
Christ et al.

(10) Patent No.: US 7,137,601 B2
(45) Date of Patent: Nov. 21, 2006

(54) CHECK RAIL DEVICE

(75) Inventors: Thomas Christ, Oberdorla (DE); Fridbert Heinze, Uelleben (DE); Ulrich Jelinski, Goldbach (DE)

(73) Assignees: BWG GmbH & Co. KG, Butzbach (DE); VAE GmbH, Vienna (AT)

( * ) Notice: Subject to any disclaimer, the term of this patent is extended or adjusted under 35 U.S.C. 154(b) by 197 days.

(21) Appl. No.: 10/515,630

(22) PCT Filed: Jun. 25, 2003

(86) PCT No.: PCT/EP03/06658

§ 371 (c)(1),
(2), (4) Date: Dec. 6, 2004

(87) PCT Pub. No.: WO2004/003297

PCT Pub. Date: Jan. 8, 2004

(65) Prior Publication Data

US 2005/0205721 A1 Sep. 22, 2005

(30) Foreign Application Priority Data

Jun. 28, 2002 (DE) ..... 102 29 258

(51) Int. Cl.
*E01B 7/00* (2006.01)

(52) U.S. Cl. ..... 246/456; 246/435 A; 246/454; 246/472; 246/463; 246/415 R; 238/17

(58) Field of Classification Search ..... 246/415 R, 246/420, 454, 463, 470, 435 A, 472, 456; 238/17, 18, 19, 21, 22, 140
See application file for complete search history.

(56) References Cited

U.S. PATENT DOCUMENTS 4,386,751 A * 6/1983 Meyer ..... 246/441
4,738,418 A * 4/1988 Farrell ..... 246/435 A
5,115,970 A * 5/1992 Rice et al. ..... 246/435 A
5,169,064 A * 12/1992 Rice et al. ..... 246/435 A
5,238,186 A * 8/1993 Young et al. ..... 104/242
6,279,833 B1 * 8/2001 Schwiede ..... 238/17

FOREIGN PATENT DOCUMENTS

| | | |
|---|---|---|
| DE | 1976647 | 1/1968 |
| DE | 29609572 | 8/1996 |
| DE | 29719799 | 6/1998 |

* cited by examiner

*Primary Examiner*—Mark T. Le
(74) *Attorney, Agent, or Firm*—Dennison, Schultz & MacDonald

(57) ABSTRACT

A check rail arrangement for a switch or an intersection, the arrangement including a grooved rail (16) provided with a grooved rail head (14), a groove (18) and a lip (52), and a check rail (12) which is supported at least on the lip and is arranged by a fixing mechanism in such a way that it can be displaced in relation to the grooved rail. The aim of the invention is to be able to easily displace the check rail. To this end, a fish-plate block (40) extends from the grooved rail (16), the fish-plate block including a longitudinal groove (42) which extends perpendicularly to the longitudinal direction of the grooved rail and in which a slot pin (44) engages in an adjustable manner. The slot pin can be tightened by a screw (46) extending from the check rail (12).

22 Claims, 6 Drawing Sheets

CHECK RAIL DEVICE

This application is a 371 of PCT/EP03/06658, filed on Jun. 25, 2003.

The invention relates to a check rail arrangement for a switch or intersection, comprising a grooved rail with a grooved rail head, a groove and a lip, a strip or secondary rail extending along the grooved rail, a check rail supported on at least the lip or machined lip and arranged so as to be adjustable relative to the grooved rail, a support element extending from the grooved rail and having an elongate receptacle extending transversely of the longitudinal direction of the grooved rail, in which elongate receptacle a fastening element is adjustably arranged, from which extends a first fastening means connected with or supported on the check rail The purpose of check rails is to guide wheels in the area of switches or intersections where there is a gap. A corresponding arrangement is known from EP 0 830 480. A check rail box extends along the arrangement, fastening means such as bolts, by means of which the check rail can be fixed, are accessible to enable a readjustment or replacement. As a result, the switch or intersection requires a large-scale construction, so cost-related disadvantages arise.

In a check rail arrangement according to DE 93 02 349 E1, a check rail is supported both laterally on the grooved rail foot and on the lip.

A check rail arrangement of the initially mentioned type is known from DE 297 19 799 U1. In this case, a check rail can be adjusted relative to a grooved rail by means of a support element in the form of a support plate extending from the grooved rail, which support plate can be welded to a profiled strip which has a slot, into which a nut for a bolt can be inserted, extending transversely of the longitudinal axis of the grooved rail, by means of which bolt a check rail profile supported on the lip of the grooved rail can be tightened.

A readjustable guide device is described in DE 296 09 572 U1. In this case, a check rail is adjusted and fixed by means of a bolt connection which can be fixed in a groove formed between transverse webs.

The object of the present invention is to form a check rail arrangement with structurally simple measures which should enable a problem-free adjustment of the check rail without the need for a check rail box. According to one aspect of the invention, it should also be ensured that there is a flush transition between the check rail and the lip of the grooved rail in the end areas of the check rail arrangement.

According to the invention, the object is essentially solved in that two mutually adjustable elements are associated with the check rail at the underside, the extent of which is variable transversely of the longitudinal direction of the grooved rail to the desired extent, the one first element being supportable against the check rail strip and the other second element against the secondary rail or an element associated with it. In particular, the invention is characterized in that the check rail is connected at the underside with a holder which is open at the secondary rail side and that the first element of the mutually adjustable two elements is supported along a boundary of the holder extending in the longitudinal direction of the grooved rail and the second element is supported at the secondary rail or the element associated with it.

According to the invention and contrary to the known prior art, the check rail is fixed by means of fastening elements (locking devices) which are adjustable in elongate receptacles, which may be designated as slide slots, extending transversely of the longitudinal axis of the grooved rail, which fastening elements are similar to slide or slot blocks, whereby a desired adjustment of the check rail to form a desired gap or slot between grooved rail head and leading edge of the check rail occurs by means of adjustment mechanisms which are formed by mutually adjustable, in particular, wedge-shaped elements, of which one of the elements is supported on the check rail or on the holder extending therefrom and the other on the secondary rail or an element associated with it (adjustment devices). Consequently, a precise width setting is made possible without the need for plates which are used according to the prior art to align the check rail.

Fastening elements such as bolts, both for the locking devices and for the adjustment devices, are accessible from the top of the check rail without the need for a check rail box or an opening of an embedding. Moreover, the check rail strip can be loosened, readjusted and fastened or exchanged with conventional tools.

The holder, functionally open at the secondary rail side, may be described as an open cage which accommodates the first and second elements, which are supported on one another in a wedge-like manner and adjustable to one another in such a way that the overall size of the elements can be changed transversely of the longitudinal direction of the grooved rail to the desired amount, one of the elements, as already mentioned, being supported directly or indirectly at the secondary rail and the other element at the boundary or wall of the cage extending in longitudinal direction of the grooved rail.

When adjustment of the first and second elements relative to one another, they are supported on surfaces extending a wedge-like manner. Furthermore, the first element, facing away from the check rail, is connected with the second fastening means, such as the lock bolt, so that when it is tightened the first element is adjusted in direction of the check rail, with the result that the second element supported on the surfaces of the first element extending in a wedge-like manner yields laterally and thus pushes away the holder fixedly connected to the check rail, i.e. the cage from the secondary rail, with the result that the groove between the leading edge of the check rail and rail head narrows.

In particular, the holder is U-shaped, the first element being supported on its transverse portion so as to be vertically adjustable. The upper second element, extending on the secondary rail, extends in turn through the holder between its side arms so as to be supported on the secondary rail.

Preferably, the first element has a quadrangular geometry with a T-shaped surface in plan view, a first rectangular surface extending along the transverse portion of the holder and triangular surfaces extending along the lateral sides of the holder, a second rectangular surface of a smaller width extending parallel to the first rectangular surface and a T-shaped undersurface, the respective triangular surface being the outer boundary of a respective first wedge-shaped section of the first element, on whose free outer surfaces, extending at an inclination to the surface of the first element, a second wedge-shaped section of the second element is supported.

Furthermore, the first wedge-shaped sections of the first element delimit a central quadrangular section which has a bore with an internal thread for interaction with the second fastening element, i.e. the adjustment bolt.

The second element has a U-geometry with sloping or wedge-shaped side arms which are supported on the first wedge-shaped sections of the first element.

It is possible, with structurally simple measures, to adjust the check rail strip towards and away from the grooved rail head by means of this wedge mechanism in order to set the width of the groove between the leading edge and grooved rail head.

To ensure a flush transition between the leading edge of the check rail and the lip of the grooved rail or a corresponding structural profile in the end region, a further embodiment of the invention provides that, as viewed in the longitudinal direction of the grooved rail, at the respective end of the check rail, a guide plate extending between the secondary rail and the lip and supported thereon is associated with the check rail, the width of the guide strip being such that the leading edge of the check rail merges smoothly with the inner surface of the lip of the grooved rail. The guide plate and the check rail are thereby penetrated by a common fastening means, such as a bolt, which is secured by a lock nut. As a result, there can be no relative movement between guide plate and check rail transversely of the longitudinal direction of the grooved rail, so that, by the fixing via the guide plate, the check rail can be adjusted relative to the lip of the grooved rail such that its leading edge merges with the inner surface of the lip in a flush manner. The first element of the wedge mechanism, which is used to adjust the check rail, can also be used as a lock nut.

The check rail can be supported both on the machined lip of the grooved rail or another structural profile and the secondary rail or strip. Lip and secondary rail are thus supports for the check rail which has, in particular, a strip geometry whose narrow sides extend at the grooved or secondary rail side. Thus, a narrow side forms a leading edge of the check rail.

In particular, the check rail comprises a wear-resistant flat material in which bores are integrated which are penetrated by first or second fastening means such as bolts in order, on the one hand, to fix the check rail (lock bolts) and, on the other hand, to adjust the check rail to the desired extent in the direction of the grooved rail head to obtain a desired groove width (adjustment bolt).

According to the invention, a separation between adjustment of the check rail and fixing of the check rail more or less occurs. In particular, the adjustment takes place by means of a wedging mechanism, whereas the fixing takes place by means of slide blocks which are preferably displaceable in slide slots. In this case, the fastening means, such as bolts, which interact with the slide blocks or the wedge mechanisms, extend from the upper side of the check rail and are thus easily accessible. It is thereby not necessary for the bolts to pass through elongate holes, whereby otherwise the danger of dirt deposits would exist to such a degree that a simple loosening of the bolt is no longer possible.

The elongate receptacle in the support element, which may in particular be a filler piece, extending between the grooved rail and the secondary rail is, as mentioned, formed particularly as a groove to receive a T-shaped slide block, which is the fastening element for the check rail. Other geometries for adjusting the fastening element along the elongate receptacle or groove, without an uncontrolled slipping out being possible, are also feasible. Thus, a dove-tailed geometry can also be selected.

The first fastening means, as lock bolts, pass through the check rail and are screwed into the fastening element or slide block in order to thereby fix the check rail by tightening of the fastening means. The head of the fastening means thereby extends in a recess of the check rail and is supported against it. The recess, which extends from the outer surface of the check rail is, in particular, a hole having a circular geometry, such that the space between the head of the bolt and boundary of the recess is determined by the size of a tool which is to grip the bolt head, so that only a limited accumulation of dirt is possible.

To reduce the moment of resistance of the check rail strip during bending, that is when the groove width is to be reduced, according to our own inventive proposal, slots extend from the longitudinal edge of the check rail at the side facing away from the grooved rail, i.e. on the secondary rail side, extend transversely of the longitudinal direction of the rail. The slots can then be covered by plates which are fixed by means of the first or second fastening means.

Depending on the length of the check rail arrangement, a plurality of locking and adjustment units are accordingly provided for fixing and adjustment the check rail strip. Accordingly, several filler pieces are present which have a through opening at the underside. This makes it possible for any accumulated water to be able to flow along an underlying plate, from which the grooved rail and the secondary rail extend, to an opening of a drainage box.

Furthermore, the check rail arrangement is covered at the ends by closure plates. Thus, an outwardly closed system is available, so that contaminations in the area between secondary rail and grooved rail below the check rail can be avoided.

With respect to the secondary rail, also referred to as a strip, it should be noted that it can consist of flat material extending along the grooved rail, which can be connected, e.g. welded, at the bottom to a plate forming a rail foot. This foot extends at the side facing away from the grooved rail. Both the grooved rail and the secondary rail can be arranged e.g. on concrete ties with an insulated Napla rail fastening. Other known arrangements are also feasible.

The filler piece and the bolt connection connecting the grooved rail or its web and the secondary rail can be a high-tensile bolt which is secured e.g. with Nordlock plates. Preferably, high-tensile M27 bolts are suitable. The lock bolt should also be secured by means of Nordlock washers.

The adjustment bolts, in turn, should be positively secured by washers which are bent on one or more flat faces of the bolt heads.

Further details, advantages and features of the invention can be found not only in the claims, the features found therein—alone and/or in combination—but also in the following description of a preferred embodiment found in the drawings, in which:

Figure 1:
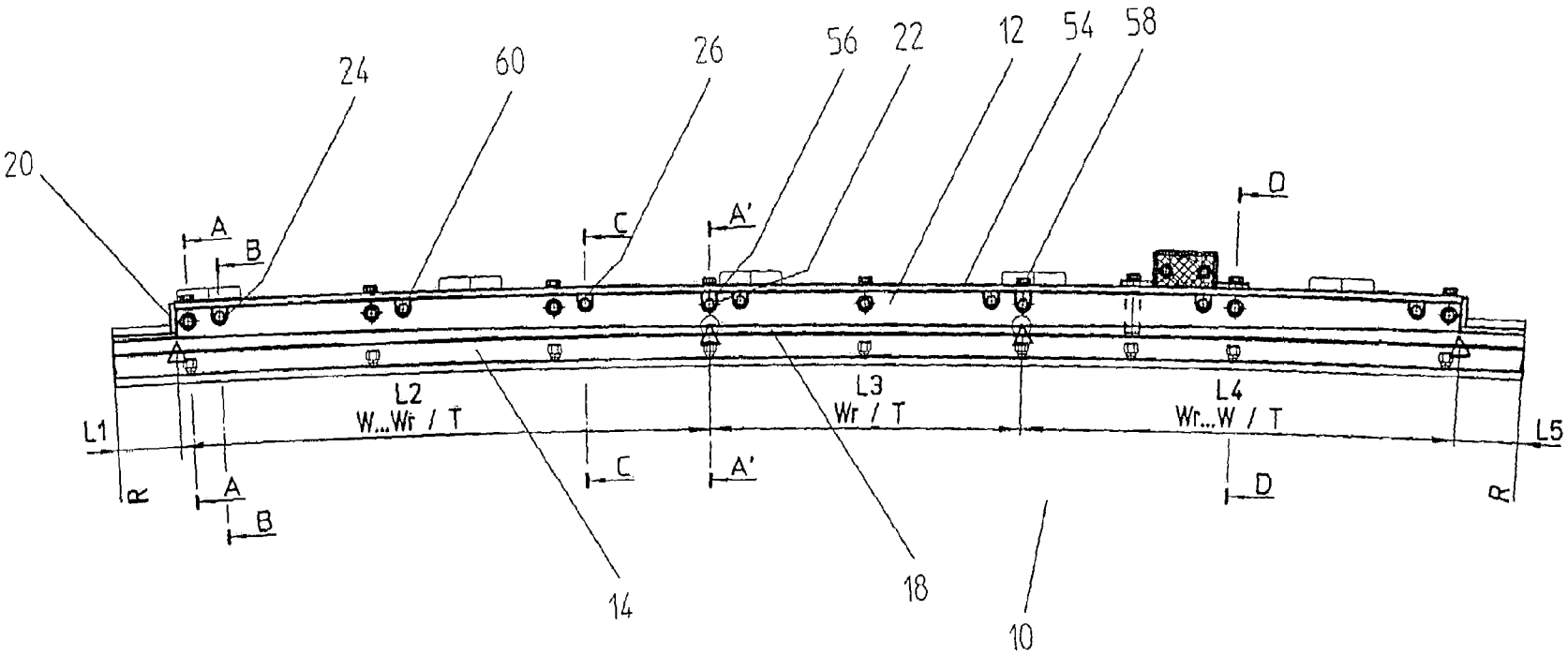
FIG. 1 shows a plan view of a check rail arrangement.

A check rail arrangement 10 intended for a switch or intersection of a grooved rail track can be seen in the figures, wherein a strip-shaped check rail 12 can be adjusted, relative to a head 14 of a grooved rail 16 or a structural profile with a groove, to form a slot 18 of the desired width. The slot 18 should thereby be narrower in the middle region L3 than in the respective end regions (L2, L4) of the check rail arrangement 10.

To securely fix the check rail 12, referred to hereinafter as a check rail strip, while simultaneously enabling the desired adjustment, the check rail arrangement 10 comprises, on the one hand, locking units 20, 22 and, on the other hand, adjustment units 24, 26. The same reference numerals are basically used for the same elements in the description.

As can be seen in particular in the cross-sectional drawings, a secondary rail 28 or a similarly acting element extends along the grooved rail 16, consisting of a flat material extending along the grooved rail 16 as first section 30 and a welded plate 32 forming a foot, the plate 32 extending along the side of the base section 30 facing away from the grooved rail. In this embodiment, secondary rail 28 or its foot 32 and grooved rail 16 or its foot 34 are arranged on concrete ties with insulated Nabla rail fastening which, in turn, extends from a base plate 36 that extends on the concrete tie.

Filler pieces 40, which are each connected or clamped together by means of a bolt connection 42, are provided in the region of the locking units 20, 22 extending between the grooved rail 16 or its web 38 and the base section 30 of the secondary rail 20. In particular, the bolt connection is a high-tensile bolt such as M27 bolts which are secured by means of Nordlock washers. However, in this respect, reference is made to known constructions.

At the check rail strip side and extending from the top surface, a slot 42 extends in the filler piece 40 transversely of the longitudinal direction of the grooved rail, in which slot there is slidably arranged a fastening means in the form of a slide block 44, which is guided securely in the slot 42 due to its geometry, e.g. a T-shaped or dove-tailed geometry. The slide block 44 has a boring with an internal thread to receive a first fastening means in the form of a bolt 46 (lock bolt), the head 48 of which extends in a recess, such as a boring 50, extending from the surface of the check rail strip 12. By shifting the slide block 40 along the slot 42, the check rail strip 12 can therefore be adjusted toward the rail head 14 or away from it in order to thereby adjust the width of the groove 18.

As can be seen in the drawings, the check rail strip 12 is supported, on the one hand, on the machined lip 52 of the grooved rail 16 and, on the other hand, by the secondary rail 28, which each form a support surface for the check rail strip 12. In this way, the check rail strip 12 is fixed in a form-locking manner on the respective support surface when the bolt 46 is tightened.

By means of the locking units 20, 22, it possible to adjust the check rail strip 12 without the bolts 46 passing through elongate holes, which would become dirty and thus make handling more difficult.

Figure 3:
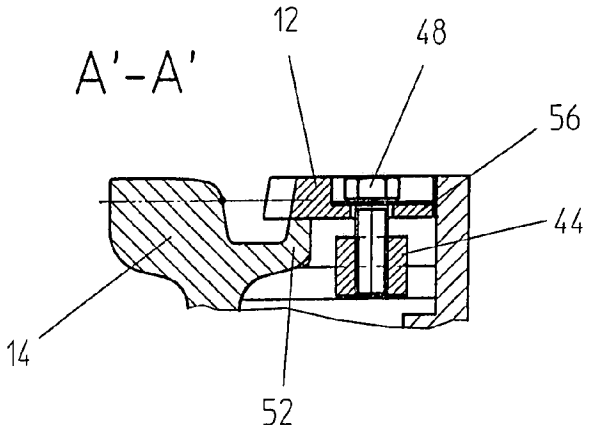
FIG. 3 shows a section along the line A'—A' in FIG. 1.
Figure 2:
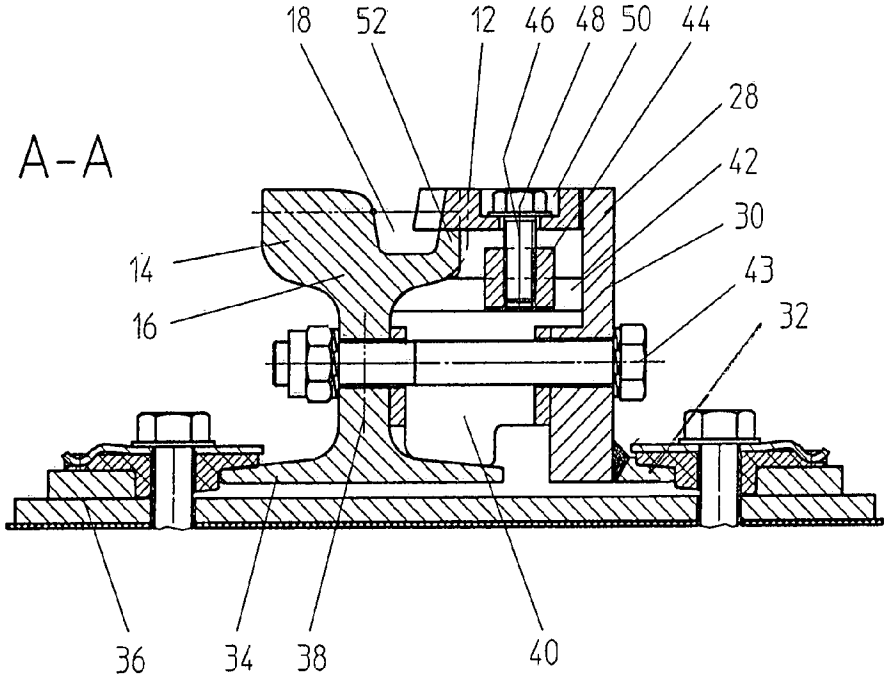
FIG. 2 shows a section along the line A—A in FIG. 1.

As can be seen in the plan view of FIG. 1, several locking units 20, 22 are provided depending on the length of the check rail arrangement 10, and likewise the adjustment units 24, 26, to be described in the following, which make it possible to adjust the check rail strip 12 in a controlled manner to the required degree. To facilitate this adjustment, i.e. to reduce the moment of resistance of the check rail strip 12 against bending, slots 56, 58, 60, extending transversely of the longitudinal axis of the check rail strip 12, extend from the longitudinal edge 54 located at the secondary rail side. A corresponding slot 56 can be seen in FIG. 3. The slots can thereby be covered by rust-proof plates which are, in turn, secured by bolts 46 or second fastening means in the form of adjustment bolts 58 extending from the adjustment units 24, 26. These will be described in greater detail with reference to FIGS. 5 and 7 to 12 and with reference to the adjustment unit 26.

The adjustment unit 26 comprises a U-shaped cage 60 which extends from the underside of the check rail strip 12 and is, in particular, welded to it. The cage 60 is open toward the secondary rail 28 or a similarly acting element, the transverse portion 62 of the U-profile extending parallel or essentially parallel to the secondary rail 28 and thus to the grooved rail 16. Side arms 64, 66 extend at a right angle to the transverse portion 62.

An insert, comprising a first element 70 and a second element 72, is movable within the cage 60 in its axial direction, i.e. along its longitudinal axis 68. The first and second elements 70 and 72 co-operate in the manner of a wedge mechanism, so that, depending on the relative positions of the first and second elements 70, 72, the effective width of the insert can be adjusted along transverse axis 74 of the cage 60 and thus transversely of the grooved rail 16 or secondary rail 28.

Consequently, the check rail strip 12 can be shifted to the desired extent in direction of the grooved rail 16 or its head 14 since the first element 70 is supported by its first outer surface 76 on the transverse portion 62 of the cage 60 and the second element 72 by its outer surface 78 on the secondary rail 28 or a corresponding element extending along the grooved rail 14.

The first element 70 and the second element 72 thereby lie against one another at wedge—or ramp-shaped surfaces 80, 82 or 84 extending at an inclination to the longitudinal axis 68 and thus slide relative to one another, on axial displacement of the first element 70 towards the second element 72, in such a way that there is a change in the distance between the outer surfaces 76 and 78 of the first and second elements 70 and 72, so that the desired bending of the check rail strip 12 is made possible.

As can be seen in the drawings, the first element 70 consists of a quadrangular base section 86 which is penetrated by a boring 88 having an internal thread. The wedge-shaped first sections 90, 92, forming the support surfaces 80, 82, extend laterally of the quadrangular section 66. In a plan view, the first element 70 is T-shaped.

The second element 72 exhibits a U-geometry, its transverse portion 94 at its outer surface (surface 78) abutting the secondary rail 28. The side arms 96, 98 have a triangular geometry in longitudinal section, the undersides forming the surfaces 84 which are supported on the surfaces 80, 82 of the first element 70.

The insert formed by the first and second elements 70, 72 can be axially adjusted relative to the cage 60 simply due to the fact that an adjustment bolt 58 passing through the check rail strip 12 engages in the internal thread of the boring 88 of the first element 70. In this way, the effective extent of the unit in the cage 60 can be adjusted as desired, transversely of the longitudinal axis of the check rail unit, and the distance between the first and second elements 70, 72 or their outer surfaces 76, 78 can thereby be modified.

The angle of inclination $\alpha$ of the surfaces 80, 82, on the one hand, and 84, on the other hand, which are supported on one another, should be in the range of $50° \leqq \alpha \leqq 70°$, in particular $\alpha$ being about 60°.

To ensure that the check rail strip 12 at its leading edge merges smoothly with the inner surface of the lip 52 at the respective end region (line 101), a plate element 100 is provided, as shown in the cross-sectional view B—B (FIG. 4), which is supported, on the one hand, on the outer surface of the lip 52 of the grooved rail 16 and, on the other hand, at the secondary rail 28, i.e. on its surface facing the grooved rail 16. The check rail strip 12 is connected with the plate element 100 by a connecting means such as a bolt and a lock nut or a similarly acting element such that a relative movement between them, transversely of the longitudinal direction of the grooved rail 16, is prevented. In this way, the check rail strip 12 can be located, relative the grooved rail 16, by the position of the opening in the plate element 100 through which the bolt extends, in such a way that the leading edge of the check rail strip merges smoothly with the inner surface of the lip 52.

Figure 4:
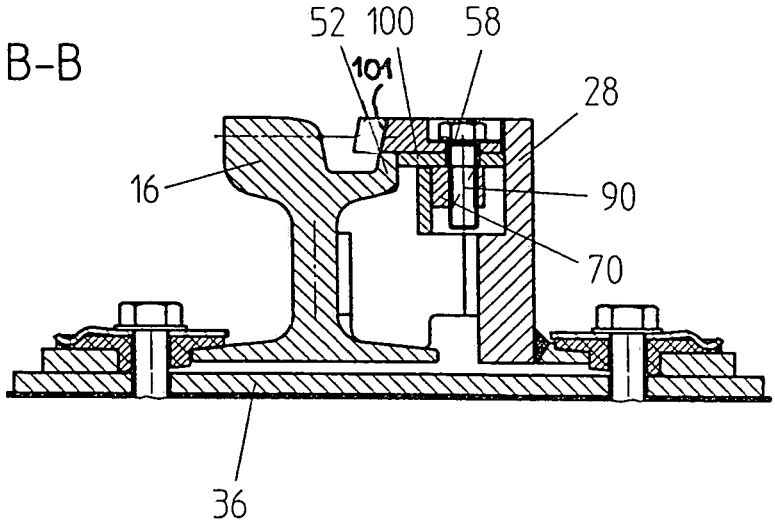
FIG. 4 shows a section along the line B—B in FIG. 1.
Figure 5:
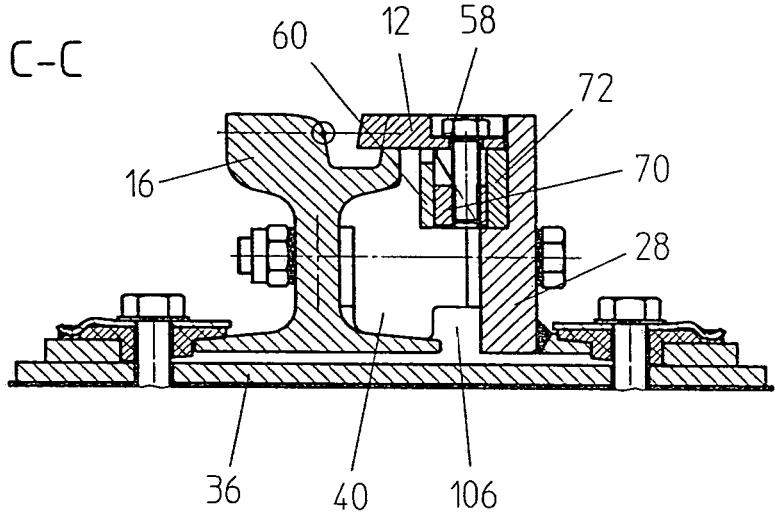
FIG. 5 shows a section along the line C—C in FIG. 1.
Figure 6:
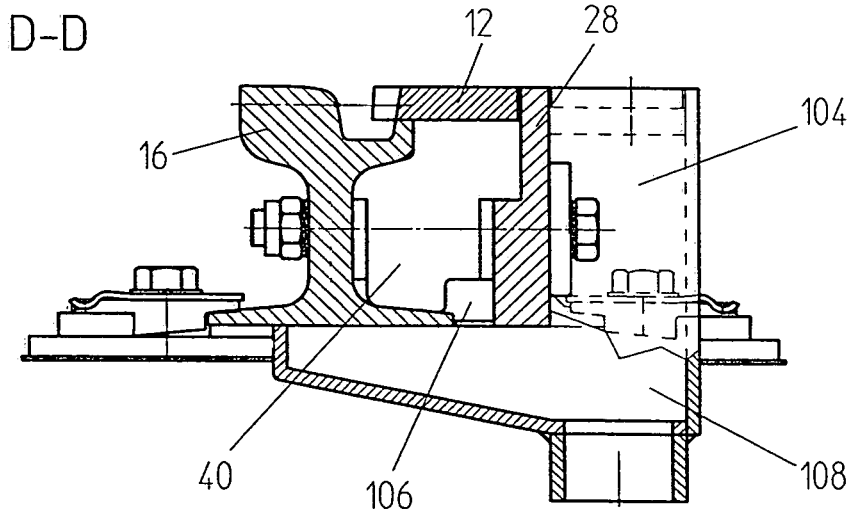
FIG. 6 shows a section along the line D—D in FIG. 1.
Figure 7:
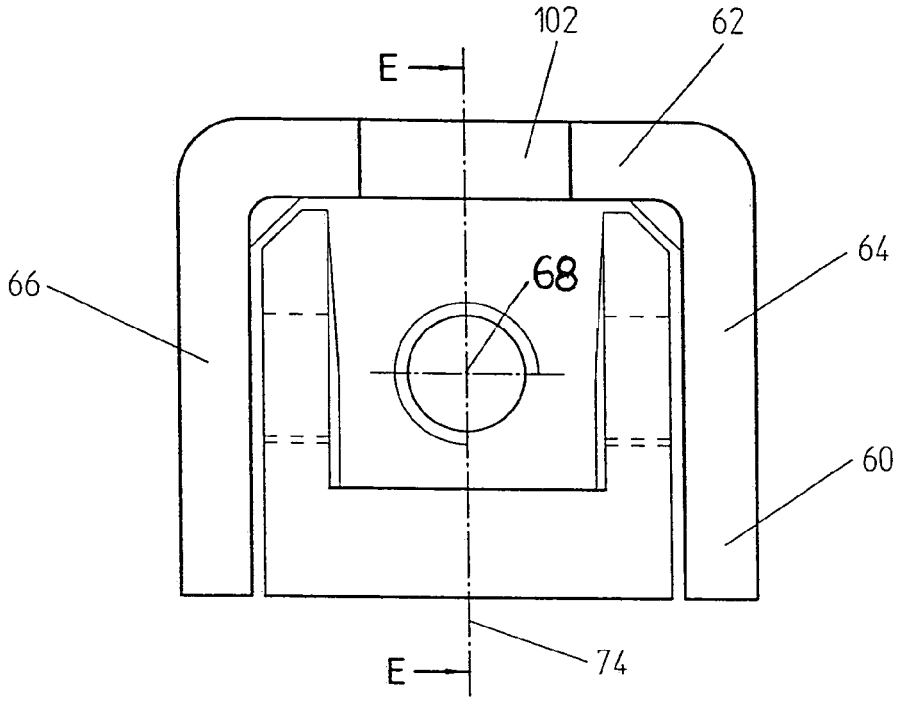
FIG. 7 shows a plan view of an adjustment unit.
Figure 8:
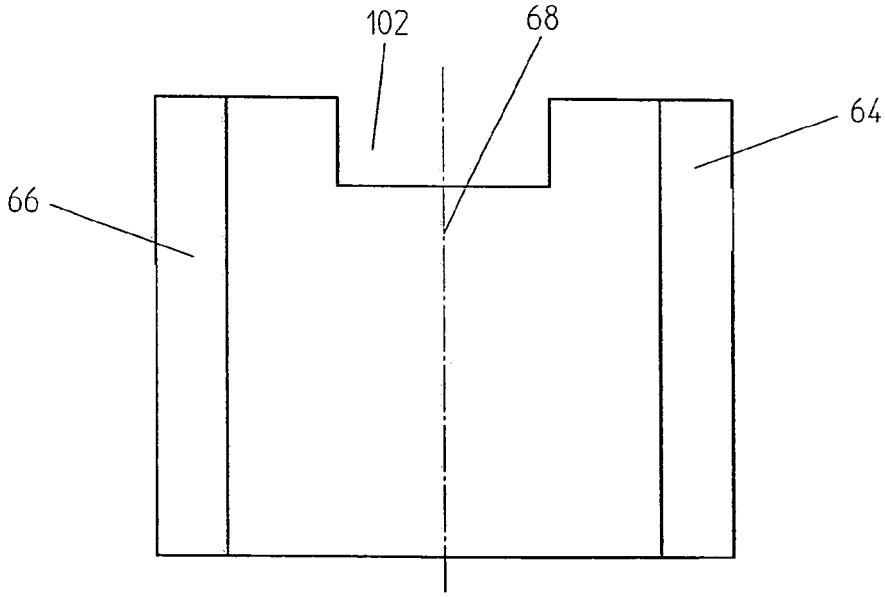
FIG. 8 shows a front view of a holder of the adjustment unit according to FIG. 7.
Figure 11:
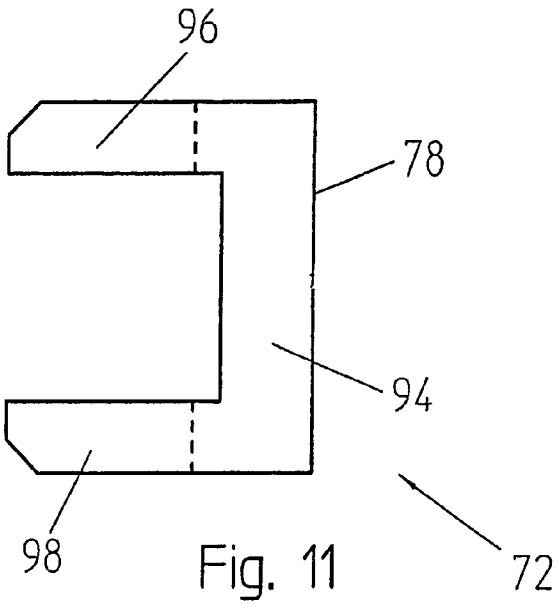
FIG. 11 shows a top view onto a second element of the adjustment unit according to FIG. 7.
Figure 9:
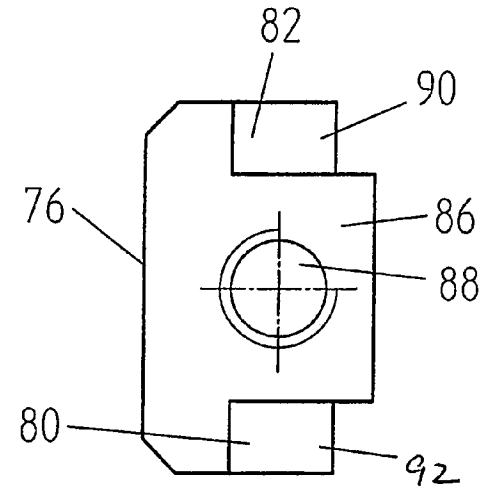
FIG. 9 shows a plan view of a first element of the adjustment unit.
Figure 10:
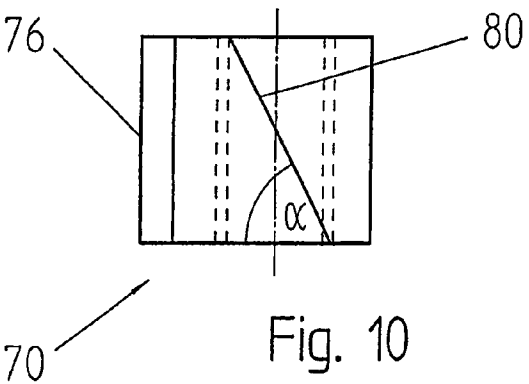
FIG. 10 shows a side view of the first element.
Figure 13:
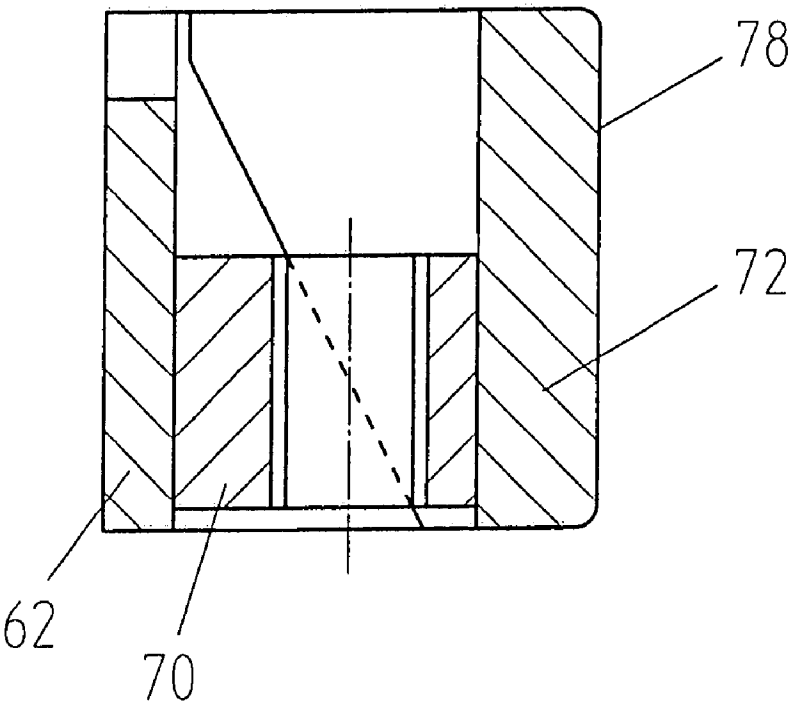
FIG. 13 shows a section along the line E—E in FIG. 7.
Figure 12:
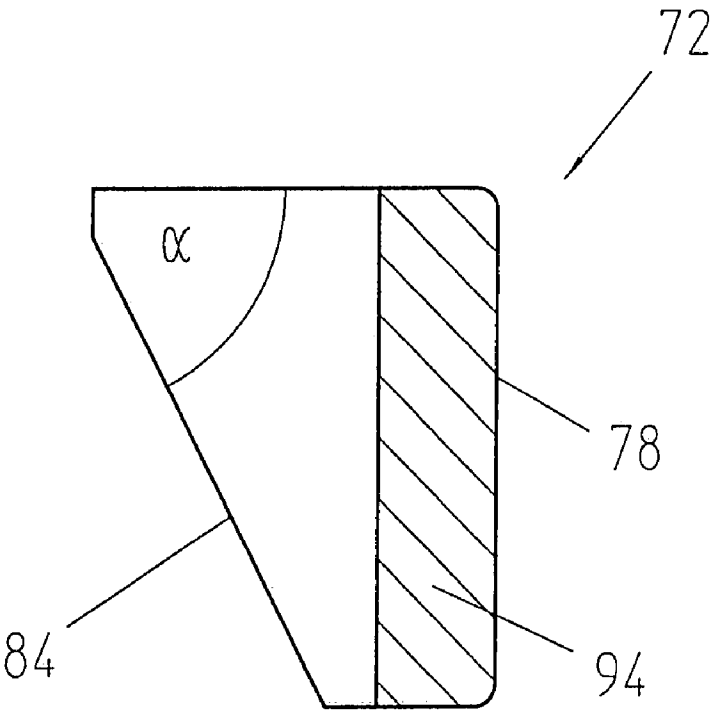
FIG. 12 shows a side view of the second element.

Preferably, the plate element 100 extends in the region of a cage 60 and passes through an recess 102 in its transverse portion 62. Furthermore, the plate element 100 is penetrated by the adjustment bolt 58, which engages in the first element 70, which, however, as in the cross-sectional view of FIG. 4, is rotated through 180°, in comparison to the arrangement of FIGS. 5 and 7 to 12, in order to act as a lock nut. This is also shown by the extent of the sloping section 90, which is illustrated by a broken line.

To ensure a drainage of the check rail arrangement 10, a conventional drainage box 104 is used which, by means of a funnel-shaped connection 108, receives water flowing through openings 106 in the bottom of the filler piece 40 and along the base plate 36.

The lock bolts 46 for fastening the check rail strip 12 are preferably secured by Nordlock washers. The adjustment bolts 58 are, in turn, secured in a form-locking manner by washers which are bent at at least one flat face of the bolt heads.

Furthermore, closure plates 110, 112 should extend from the front surface of the secondary rail 28 to the grooved rail 16 in order to obtain a closed system between grooved rail 16 and check rail strip 12 and secondary rail 28.

The invention claimed is:

1. A check rail arrangement (10) for a switch or intersection, comprising a grooved rail (16) with a grooved rail head (14), a groove (18) and a lip (52), a strip or secondary rail (28) extending along the grooved rail, a check rail (12) supported on at least the lip and arranged so as to be adjustable relative to the grooved rail, a support element (40) extending from the grooved rail (16) and having an elongate receptacle (42) extending transversely of the longitudinal direction of the grooved rail, in which elongate receptacle a fastening element (44) is adjustably arranged, from said fastening element extends a first fastening means (46) connected with or supported on the check rail (12), characterized in that two mutually adjustable elements (70, 72) are associated with check rail (12) at the underside of the check rail, an extent of said mutually adjustable elements is variable transversely of the longitudinal direction of the grooved rail to a desired extent, a first one of said adjustable elements being supportable against the check rail and the other second element (72) against the secondary rail or an element allocated to it.

2. The check rail arrangement according to claim 1, characterized in that the check rail (12) is connected at the underside with a holder (60) which is open to the secondary rail and that the first element (70) of the mutually adjustable two elements (70, 72) is supported along a boundary (62) of the holder extending in the longitudinal direction of the grooved rail (16) and the second element (72) is supported at on the secondary rail (28) or the element associated with it.

3. The check rail arrangement according to claim 1, characterized in that the first and second elements (70, 72) are supported on top of one another by wedge-shaped surfaces (80, 82, 84).

4. The check rail arrangement according to claim 1, characterized in that the first element (70), which is remote from the check rail (12), is adjustable by means of a second fastening means (58) extending from the check rail.

5. The check rail arrangement according to claim 1, characterized in that a holder (16) is U-shaped, the first element (70) being supported at a transverse portion (62) of the holder so as to be adjustable.

6. The check rail arrangement according to claim 2, characterized in that the second element (72), extending at the secondary rail, passes through the holder (60) between its lateral side arms (64, 66).

7. The check rail arrangement according to claim 1, characterized in that the first element (70) has a quadrangular geometry with a T-shaped surface (86) in plan view, a first rectangular surface (76) extending along a transverse portion (62) of a holder (6) and triangular surfaces extending along lateral sides (64, 66) of the holder, a second rectangular surface of a smaller width extending parallel to the first rectangular surface and a T-shaped undersurface, a respective triangular surface being an outer boundary of a respective first wedge-shaped section (90, 92) of the first element, on free outer surfaces (80, 82) of the wedge shaped section, extending at an inclination to the surface of the first element, a second wedge-shaped section (96, 98) of the second element (72) is supported.

8. The check rail arrangement according to claim 2, characterized in that first wedge-shaped sections (90, 92) of the first element (70) delimit a central quadrangular section which has a boring (88) with an internal thread for interaction with a second fastening means (58) passing through the check rail (12) and supported against it.

9. The check rail arrangement according to claim 6, characterized in that the second element (72) has a U-geometry with side arms (96, 98) which are a second wedge-shaped sections supported on first wedge-shaped sections (90, 92) of the first element (72).

10. The check rail arrangement according to claim 1, characterized in that viewed in the longitudinal direction of the grooved rail (10), at the respective end of the check rail (12), there is arranged a guide element formed as a guide plate (100), extending between the secondary rail (28) and the lip (52) and supported thereon, the width of which guide element is determined such that the leading edge of the check rail is flush with the inner surface of the lip (14) of the grooved rail (16).

11. The check rail arrangement according to claim 10, characterized in that the guide element, formed as a guide plate (100) is connected with the check rail (12) by means of a second fastening means (58), which interacts with the first element (70) as a lock nut.

12. The check rail arrangement according to claim 10, characterized in that the guide plate (100) passes through an opening (102) of a transverse portion (62) of a holder (6) and is fixed between the underside of the check rail (12) and bottom surface of the first element (70).

13. The check rail arrangement according to claim 1, characterized in that the check rail (12) is positioned relative to the grooved rail (16) by a plurality of locking and adjustment units (20, 22, 24, 26).

14. The check rail arrangement according to claim 1, characterized in that the grooved rail (16), in the area of the check rail arrangement (10), extends from a base plate (36), that several filler pieces (40) are arranged as the support elements (40) between the grooved rail and the secondary rail (28), the support elements each having at its underside an opening (106), and that an opening leading to a drainage box (104) extends from an underlying plate.

15. The check rail arrangement according to claim 1, characterized in that the check rail arrangement (10) is covered on the ends thereof by closure plates (110, 112).

16. The check rail arrangement according to claim 1, characterized in that the secondary rail (28) comprises flat material extending parallel or substantially parallel to a web (38) of the secondary rail (28) with a welded plate element (32) protruding from a side of the secondary rail facing away from the grooved rail as a foot.

17. The check rail arrangement according to claim 1, characterized in that the check rail (12) has a strip geometry, the narrow sides of which extend at sides of the grooved and secondary rails.

18. The check rail arrangement according to claim 1, characterized in that the check rail (12), configured as a check rail strip, comprises wear-resistant flat material.

19. The check rail arrangement according to claim 1, characterized in that the support element (40) is arranged as filler piece between the grooved rail (16) and the secondary rail (28) and is connected with them by a bolt connection.

20. The check rail arrangement according to claim 1, characterized in that a slide block having a T-geometry, as the fastening element (44), is arranged so as to be slidable in the elongate receptacle (42), formed as a groove.

21. The check rail arrangement according to claim 20, characterized in that the slide block (44) can be tightened against the check rail (12) by means of a bolt as the first fastening means (46), the bolt having a head (48) which extends in an opening, formed as a round hole (50), extending from an outer surface of the check rail.

22. The check rail arrangement according to claim 1, characterized in that slots (56, 58, 60), extending in the direction of the grooved rail (16), extend from a longitudinal side (54) the check rail (12) facing away from the grooved rail.

* * * * *